United States Patent [19]

Schubach et al.

[11] Patent Number: 4,877,395

[45] Date of Patent: Oct. 31, 1989

[54] SYSTEM CONTROL MEANS TO PREHEAT WASTE OIL FOR COMBUSTION

[76] Inventors: Gary Schubach, South 4805 Farr Rd., Spokane, Wash. 99206; Frank Schubach, N. 1406 Aladdin Rd., Spokane, Wash. 99016

[21] Appl. No.: 253,268

[22] Filed: Oct. 4, 1988

Related U.S. Application Data

[62] Division of Ser. No. 65,919, Jun. 22, 1987, Pat. No. 4,797,089.

[51] Int. Cl.[4] ..... F23N 5/00

[52] U.S. Cl. ..... 431/28; 431/37; 431/208

[58] Field of Search ..... 431/28, 36, 37, 38, 431/208

[56] References Cited

U.S. PATENT DOCUMENTS

| | | | |
|---|---|---|---|
| 1,688,796 | 7/1924 | Baker . | |
| 2,818,110 | 12/1957 | Rulseh | 431/37 X |
| 2,841,215 | 7/1958 | Messer . | |
| 3,070,151 | 12/1962 | Goossens | 431/28 |
| 3,118,490 | 1/1964 | Page-Roberts et al. | 431/208 |
| 3,584,194 | 6/1971 | Kautz et al. | 219/302 |
| 3,835,294 | 9/1974 | Krohn et al. | 219/302 |
| 4,081,234 | 3/1978 | Mueller | 431/208 |
| 4,197,819 | 4/1980 | Mahoney et al. | 219/275 |
| 4,199,675 | 4/1980 | Sharpless | 219/302 |
| 4,286,140 | 8/1981 | Dewulf et al. | 219/305 |
| 4,340,354 | 7/1982 | Schwarz | 219/302 |
| 4,392,810 | 7/1983 | Bears et al. | 431/208 |
| 4,392,812 | 7/1983 | Yoshii | 431/208 |
| 4,460,328 | 7/1984 | Niederholtmeyer | 431/208 |
| 4,465,922 | 8/1984 | Kolibas | 219/302 |
| 4,480,172 | 10/1984 | Ciciliot et al. | 219/302 |
| 4,513,568 | 4/1985 | Bajulaz . | |

FOREIGN PATENT DOCUMENTS

| | | | |
|---|---|---|---|
| 2738377 | 3/1979 | Fed. Rep. of Germany | 431/208 |
| 2846282 | 5/1979 | Fed. Rep. of Germany | 431/208 |
| 3210387 | 9/1983 | Fed. Rep. of Germany | 219/302 |
| 858876 | 1/1969 | United Kingdom | 219/305 |

*Primary Examiner*—Randall L. Green
*Attorney, Agent, or Firm*—Mark W. Hendricksen

[57] ABSTRACT

An apparatus for a system control means to control the temperature and preheat of waste oil in a waste oil feed system and burner. The apparatus includes the combination of a heat transfer assembly with a helical passageway through a preheat means, a system control means, an anticipatory rate-proportional bank temperature control means, and an expansion pressure relief means for cold startup.

3 Claims, 4 Drawing Sheets

SYSTEM CONTROL MEANS TO PREHEAT WASTE OIL FOR COMBUSTION

CROSS-REFERENCES TO RELATED APPLICATIONS

This is a DIVISIONAL application from out prior U.S. Application Ser. No. 07/065,919, filed June 22, 1987, now U.S. Pat. No. 4,797,089, from which 35 USC 120 filing benefit is hereby claimed:

BACKGROUND OF THE INVENTION

1. Field of the Invention

This invention generally relates to an improved apparatus for controlling the temperature and preheat of waste oil in cooperation with a waste oil burner. More particularly, the invention relates to such an apparatus comprised of a system control means, a temperature control means, a heat transfer assembly for preheating the oil, and a pressure relief means to eliminate nozzle drip.

2. Description of the Prior Art

For many years, various methods and apparatus have been employed to attempt to preheat oil and other combustibles to obtain proper atomization of the oil for burning. Conventional oil burners frequently use the pressure atomizing principle and waste oil burners typically preheat the oil in order to reduce the viscosity and to make pressure atomization possible.

The application of such systems and methods to heavy oil and used oil of varying types, "waste oil," has created several problems which, up until now, have not been sufficiently overcome.

The problems with prior art can best be explained in light of the properties of waste oil in general. Because waste oil has already been in use, its viscosity is generally much higher than regular and unused heavy oil and it also has a substantially higher particle and dirt content. Additionally, with today's automobile oil being predominantly multi-viscosity and containing additives and polymers to achieve multi-viscosity properties, the problems are magnified. The characteristics and properties of a medium or heavy oil are substantially changed by the additives that are introduced to render the oil multi-viscosity. As an example, the temperature at which multi-viscosity oil experiences the formation of solid carbonaceous residue, i.e. coking, is substantially reduced.

The characteristics and properties, including the viscosity, of medium and heavy oils are also substantially affected by the typical use of the oil in an automobile or other engine. The typical use of oil in engines not only breaks down and thereby increases the viscosity of the oil, but also adds a significant amount of foreign particles to the oil, such as dirt and grime.

The effect on medium and heavy oils of the multi-viscosity additives, continued high-temperature use and the addition of dirt and grime, alter the properties of the oil to such an extent that the efficient, effective, and maintenance-free preheating and combustion of waste oil has until now, not been sufficiently achieved.

The temperature at which waste oil forms a solid carbonaceous residue, i.e. coking, is drastically reduced as compared to clean heavy oil prior to its use. At the same time, because of the increased viscosity from use and from the introduction of additives, dirt and grime, the waste oil must be heated to a higher temperature to obtain proper atomization. The result is that there is a very narrow temperature range which must be reached and maintained in order to obtain a sufficient viscosity to achieve proper atomization, while avoiding coking and other problems which require substantial maintenance of the system and adversely affect the performance of the burner. The high temperature limitations must be maintained not only at the nozzle, but throughout the preheater and oil feed system.

The oil burner systems represented by prior art and in the industry are designed and configured such that if or when used for waste oil, they experience coking and other maintenance problems on the heat transfer surface and along the oil path, as well as inefficient and inconsistent atomization. The solid residue not only eventually covers and corrodes the heat transfer surface of the preheat means, but also clogs the oil passageway and requires the unit to frequently be disassembled to undergo maintenance, including cleaning and replacement of parts. The solid residue formed in the coking process will also periodically partially break or flake off, and flow with the oil to the nozzle filter, which it then blocks.

The prior art and systems employed in the industry require frequent maintenance for several reasons. The first is that the actual heater element is typically positioned too remote from the nozzle, resulting in excessive heat loss in passage to the nozzle. Because of this heat loss and the target oil temperature at the nozzle, waste oil must be heated to too high of a temperature at the heater. This results in coking on the heating element as well as in the passageway.

Secondly, to obtain a high enough temperature to compensate for the heat loss of the oil in passage to the nozzle, conventional heating means transfer an excessive amount of energy per area of heat transfer surface between the heater and the waste oil. This is referred to as watt density or watts per square inch for the heat transfer area. The allowable watt density for waste oil is generally substantially lower than that for regular medium and heavy oil and is approximately eleven to thirteen watts per square inch.

Exceeding the allowable watt density for waste oil causes coking on the heat transfer surface, which gradually impinges and reduces the heat transfer to the oil and the ability to sufficiently raise the temperature of the oil. Coking is a condition which causes the need for a substantial amount of maintenance, not just on the heat transfer surface and in the oil passageway, but also at the nozzle.

The prior art has heretofore been unable to sufficiently reduce the coking and maintenance problems for waste oil systems. The waste oil heaters and burners in the market today have also been unable to achieve sufficient temperature control of the oil atomized at the nozzle. Insufficient or inaccurate temperature control results in insufficient atomization and incomplete combustion. The prior art utilizes unresponsive, remote and inaccurate temperature sensing devices to obtain and maintain the preferred oil temperature at the nozzle.

The failure of the prior art to maintain sufficient temperature control of the waste oil being atomized at the nozzle has led to several problems with the performance of the waste oil burner and the maintenance of the unit. First of all, if the temperature of the waste oil at the nozzle is too high, coking occurs at and around the nozzle. This substantially reduces the ability of the nozzle to properly atomize the waste oil and obtain complete combustion. The coking resulting from too high a temperature at the nozzle will corrode and clog the nozzle and require frequent maintenance and/or replacement of it. If the oil temperature upstream from the nozzle is allowed to exceed the coking temperature, then coking occurs upstream. The residue formed by coking will partially breakup during operation, causing flakes and particles to flow with the oil through the oil passageway and cover and clog the nozzle filter, which requires additional maintenance.

The inefficient and inconsistent atomization and resultant combustion greatly reduces the ability of the heater to maintain a constant, controllable and predictable heat output. This causes unacceptable temperature variation in the space heated.

If the waste oil passing through the nozzle is not at a sufficiently high temperature, it will not properly atomize or fully combust. This results in the formation of clinkers or solid carbonaceous formations in the combustion chamber, substantial wearing and destruction of the nozzle, and consequently, higher maintenance.

The industry and prior art typically utilize what is referred to as a "bi-metal snap disc thermal switch control" temperature sensor/control to monitor and control the temperature of the waste oil. These snap disc thermal switch controls typically have a 20 degree Fahrenheit control variation. The temperature variations allowed by bi-metal discs are too large for an efficient waste oil system and results in what is commonly referred to as overshoot and droop. The snap discs are generally configured to activate and turn the heater off when the oil temperature reaches 10 degrees above the target temperature. However, because the temperature rise does not immediately stop, the oil coming through the passage will rise to as high as 10–20 degrees Fahrenheit above the target temperature. This is commonly referred to as "overshoot," and overshoot causes coking and the many other problems discussed herein.

The typical waste oil burner in the industry today, utilizing the bi-metal snap disc thermal control, does not operate again until the oil temperature drops approximately twenty degrees below the set point temperature. The snap disc thermal control will then activate and turn the heating element on when the oil temperature drops 20 degrees below the target temperature. The temperature of the waste oil continues to drop for a period of time until the heating element is energized and then heats the temperature back up to the set-point temperature. The actual temperature of the oil can drop as much as fifteen or twenty degrees below the target temperature. This is referred to as "droop." Droop results in incomplete combustion, clinker build-up in the combustion chamber, excessive wear and corrosion on the nozzle and other problems discussed herein.

Another objective which must be achieved in order to greatly reduce the maintenance and increase the efficiency of a waste oil feed apparatus and preheat method is to prevent the flow of oil through the nozzle when the oil is at too low a temperature to properly atomize.

Prior art has attempted to reduce this problem by placing inlets and/or complicated valve arrangements adjacent to the nozzle, including some type of structure or means for closing off the oil supply line from the nozzle. A different method disclosed by prior art for preventing the standing cold oil from discharging through the nozzle is by use of a purge line with a second pump means and a time delay valve control means to close the purge line valve on startup after a predetermined time interval See Bears, et al. U.S. Pat. No. 4,392,810.

The problems in the industry and in prior art caused by reaching too high a temperature are greatly reduced by our new heat transfer assembly by controlling its receipt and distribution of heat from the heating element and its distribution thereof throughout the assembly and the resultant transfer of heat to the oil passing through the helical passageway. This has also been accomplished through the use of the temperature and system control means described in this specification.

Our invention has greatly reduced or eliminated the problem of exceeding the allowable watt density of waste oil during preheat by utilization of a helical oil passageway through an aluminum heat transfer assembly, which surrounds a cylindrical cartridge type electrical resistance heater. The distribution and transfer of heat through our heat transfer assembly and to the oil in the passageway has effectively re-distributed the transfer of the heat, reduced the watt density for transfer of heat to the waste oil, and greatly reduced the coking, carbonization and consequent maintenance problems that occur in prior art and other systems.

Our invention has substantially reduced the coking and maintenance required on the waste oil feed systems, burners, and nozzles to an extent the prior art and the industry have heretofore been unable to achieve.

Our invention utilizes an anticipatory function and a rate proportional band function in its temperature controls to greatly reduce or eliminate both overshoot and droop and the problems associated therewith. Our invention also greatly reduces the temperature variation from the target temperature during the normal operating cycle, or to approximately plus or minus one degree.

Our invention is distinguished from prior art because it utilizes a simple and inexpensive control system that, upon cold startup, does not energize the fuel pump, the electrodes, or the heater fan until the heat transfer assembly has reached a predetermined temperature, i.e., the set-point temperature. During the cold startup period and before the fuel pump is energized, the standing cold oil in the heat transfer assembly is heated, which causes it to expand within the heat transfer assembly. In order to prevent this expanding oil from flowing through the nozzle, our invention includes an expansion pressure relief means which creates less resistance to the flow of the expanding oil than the nozzle and, therefore, receives the flow of expanded oil. This allows the nozzle to remain continually open while providing a pressure expansion relief means. Our invention discloses a simple, inexpensive means to prevent oil from being discharged through the nozzle on cold startup.

Our invention is distinguished from prior waste oil burners and systems individually or any combination of it by providing an apparatus which eliminates the problems relating to all prior art as discussed more fully herein.

SUMMARY OF THE INVENTION

Our invention generally provides an apparatus for controlling the temperature of, and preheat system for, waste oil, in cooperation with a typical waste oil burner and which can be used for both an oil pressure driven atomization and an air pressure driven atomization system.

An object of our invention is to greatly reduce coking at the heat transfer surface, in the waste oil passageway and at the nozzle, by reducing the high temperature heating requirement and by maintaining the energy transfer rate per area, watt density, below the maximum for waste oil. In carrying out this object, the invention is comprised of the combination of an anticipatory proportional band temperature control system, a heat transfer assembly placed adjacent to the nozzle and a heat monitoring thermocouple at the nozzle chamber.

This forenamed combination also accomplishes a further object of the invention, namely to greatly reduce the flame impingement, inefficient burning and incomplete combustion occurring in the waste oil burner industry.

A further object of our invention is to provide a temperature and process control system accurate and responsive enough to obtain and maintain the target temperature of the waste oil at the nozzle with a sufficiently low variation. This object is carried out through the combination of use of an anticipatory proportional band temperature control system, our heat transfer assembly and a heat monitoring thermocouple at the nozzle chamber in the heat transfer assembly.

A further object of our invention is to prevent waste oil at too low of a temperature from being forced through the nozzle and to do so in a simple, effective and inexpensive manner. To carry out this objective during cold startup of the waste oil burner, a pressure expansion relief means is utilized. To carry out this objective during the normal operating cycle of the burner, our invention utilizes a system control means which maintains the temperature in the heat transfer assembly during the time the burner is not providing heat to the space and does not allow energization of the oil pump to operate during that time. Therefore, there is no oil flow or expansion during this period in the operational stage.

Other and further objects of our invention will appear from the specifications and accompanying drawings which form a part hereof. In carrying out the objects of our invention, it is to be understood that its essential features are susceptible to change in design and structural arrangement with only one practical and preferred embodiment being illustrated in the accompanying drawings as is required.

BRIEF DESCRIPTION OF THE DRAWINGS

In the accompanying drawings which form a part hereof and wherein like numbers of reference refer to similar parts throughout.

DESCRIPTION OF PREFERRED EMBODIMENT

Our invention generally provides an apparatus for the system control and preheat of waste oil in a waste oil feed system and burner, which can be used in cooperation with a conventional space heater.

Many of the fastening means, connection means and piping means utilized in the invention are generally widely known in the field of the invention described and their exact nature or type is not necessary for an understanding and use of the invention by a person skilled in the art and they will not therefore be discussed in detail.

Figure 1:
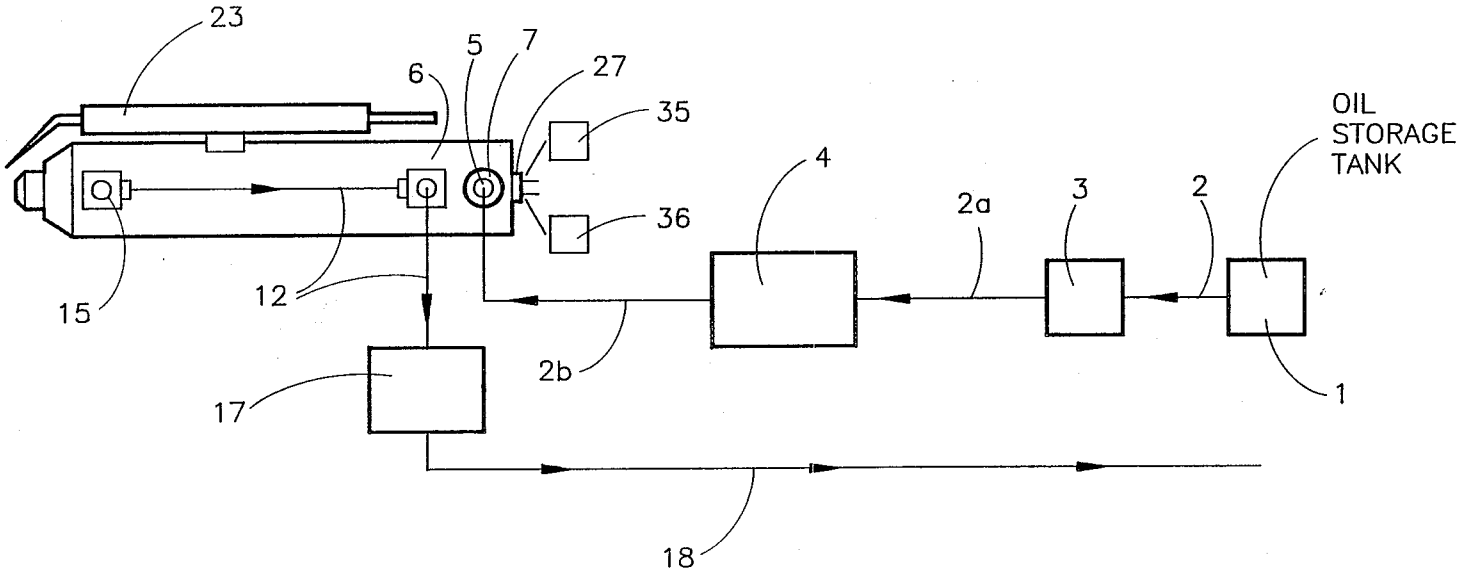
FIG. 1 is a schematic view showing the important components of the waste oil preheater system.

FIG. 1 shows a schematic of the oil pressure atomization application of the waste oil burner system according to the invention. The oil supply line 2 is immersed at one end in the waste oil fuel in the oil storage tank 1 and connected at the other end by common means to the oil filter 3. The outlet side of the oil filter 3 is connected to the oil supply line 2*a* which is connected at the other end to the fuel pump 4.

The outlet from the fuel pump 4 is conventionally connected to the oil supply line 2*b*, which is connected on its other end to the inlet means 5 to the heat transfer assembly 6. The inlet means of the heat transfer assembly 6 consists of a cylindrical plug 7, axially drilled and internally threaded to accept the externally threaded oil supply line inlet connection 5. The plug 7 is heli-arc welded 8 to the heat transfer assembly 6 to affix it and further comprise the connection means.

The oil entering the heat transfer assembly 6 then passes through the helical passageway 9 and into the nozzle filter chamber 10 by a passageway means 11 that will be discussed later.

Figure 2:
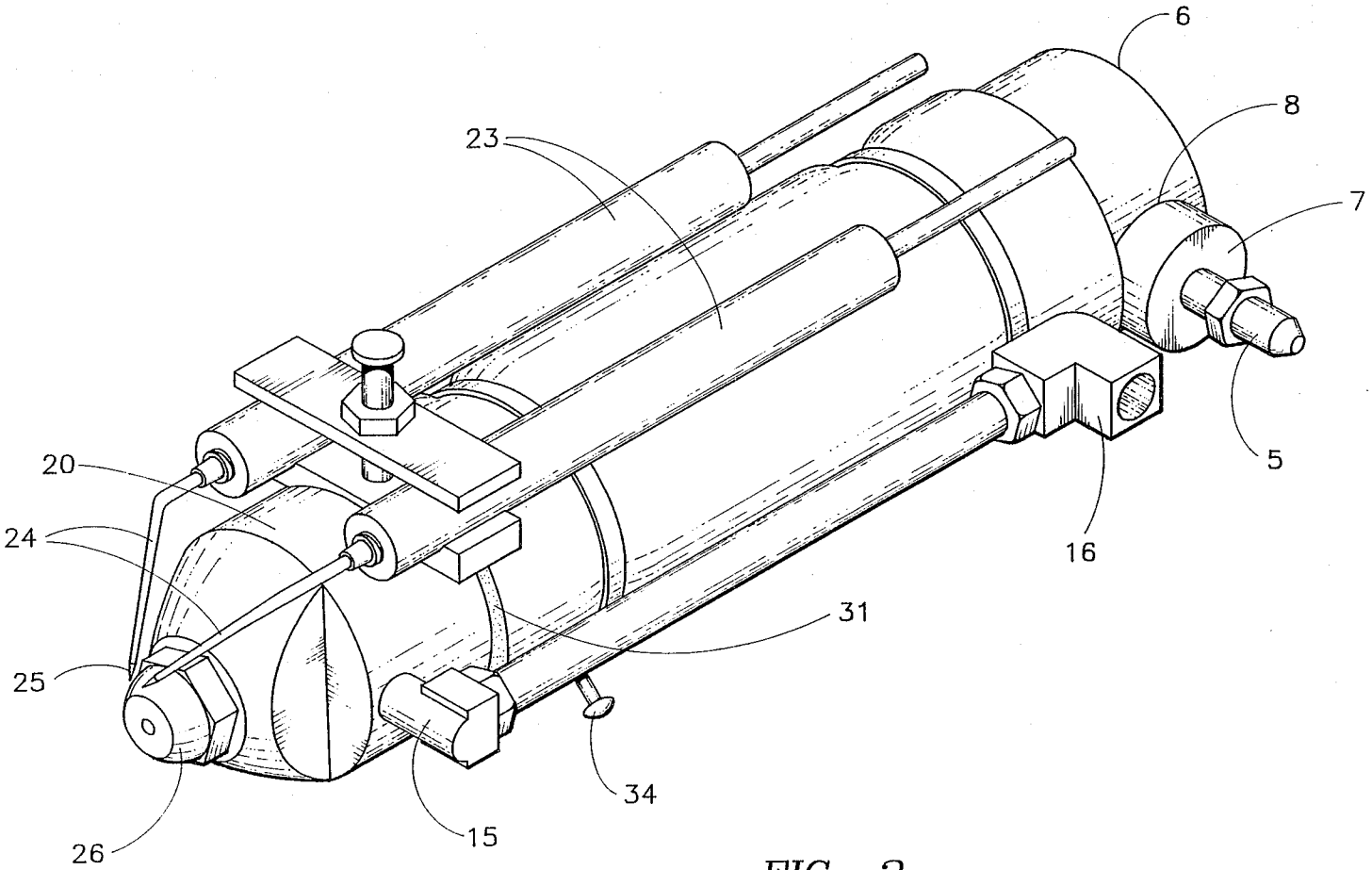
FIG. 2 is a plan view showing the heat transfer assembly with the electrodes configured in place.

To accommodate the expansion pressure relief line 12 from the nozzle filter chamber 13, a hole or inlet 14 is bored and internally threaded to mate with the inlet elbow 15. The elbow 15 is conventionally connected to the pressure relief line 12, which, at its other end, is conventionally connected to a second elbow junction 16 as shown in FIG. 2.

From elbow 16, the expansion pressure relief line 12 is conventionally connected to an expansion pressure relief solenoid valve 17. The pressure relief solenoid valve 17 is then conventionally connected to the piping means 18 and facilitates the expansion of the oil back into the oil supply tank 1.

According to our invention, the waste oil is pumped by means of a positive displacement type oil pump 4 through a conventional oil filter 3 to reduce the particulate content of the fuel. The waste oil pump is a commonly used waste oil "Mini-pump," which can be obtained from Suntec company, and is rated at approximately thirteen to fifteen gallons per hour. The fuel is drawn through the filter by the vacuum created by the oil fuel pump 4 and then travels through the pump 4. The target backpressure needed to be achieved by the fuel pump 4 in order to properly atomize the oil fuel is approximately one hundred pounds per square inch.

The desired flow rate for the preferred embodiment of the invention is one and one-half gallons per hour and since the pump we use is rated at approximately thirteen to fifteen gallons per hour, approximately twelve gallons of oil per hour continually pass through.

From the fuel pump 10 the fuel is transported through conventional piping to the inlet 5 of the heat transfer assembly 6, where it enters the inlet cylindrical plug 7 to the heat transfer assembly 6, as shown in FIG. 2. The inlet means to the heat transfer assembly 6 consists of a cylindrical plug 7, axially drilled and internally threaded to accept the externally threaded oil supply line connective means. The plug 7 is heli-arc welded to the heat transfer assembly 6 to affix the connection means.

After the fuel passes through the inlet means of the heat transfer assembly, it enters the helical path 9 through the heat transfer assembly 6, where it is preheated for efficient atomization and combustion. The special design, passageway 9 configuration and means for transferring heat to the fuel in the heat transfer assembly 6 results in the fuel exiting the passageway 9 in the assembly and into the drilled hole 11, which serves as a passageway connectives means in combination with the radially drilled hole 19 to pass the fuel oil to the nozzle filter chamber 13. Once the radially drilled hole 19 is made, it is partially plug-welded to seal the passageway configuration.

The oil in the nozzle filter chamber 13 is then either forced through the nozzle filter and then atomized for combustion by the nozzle, or it passes into the inlet of the cold start pressure relief line 12.

As shown in FIGS. 1 and 2, there is a pressure relief line 12 to absorb the ambient standing oil which is in the system on a cold startup and which undergoes substantial expansion during the heating up phase of the preheater on a cold startup. The pressure relief line 12 also relieves residual pressure and the associated fuel oil flow which is experienced during the operational cycle during the shutdown of the heat transfer assembly. The expanding oil on cold startup inlets the pressure relief line 12 in the nozzle filter chamber 13. The core component 20 of the heat transfer assembly 6 has an internally threaded entry to the nozzle filter chamber 13 for connection of the pressure relief line 12 to heat transfer assembly 6.

The expanding oil passing through the pressure relief line 12 is controlled by means of an electronically controlled, normally open solenoid valve 17. The valve is normally open and allows the expanding oil to flow through it and back to the oil storage tank 1 with nominal resistance. On a cold startup, the temperature of the heat transfer assembly 6 is raised to the set point for the system, which approximately ten degrees below the target operating temperature for the proper atomization of the fuel, which is 210 degrees Fahrenheit. The set point temperature is 200 degrees Fahrenheit. During this expansion phase of cold startup, the resistance presented by the oil pressure atomized nozzle 22 is sufficiently greater than that of the open pressure relief line 12, that the oil flows through the pressure relief expansion line 12.

During the cold startup phase, the control system of our invention is targeted to the set point temperature, and when the heat transfer assembly 6 reaches this temperature, the normally open solenoid valve 17 in the pressure relief line is energized and closed. The closure of the pressure relief line via the solenoid valve 17 allows sufficient pressure to accumulate in the nozzle filter chamber 13 to then force the oil through the nozzle at a temperature and pressure sufficient to properly atomize and efficiently combust the fuel oil.

The fuel oil is atomized by the nozzle and ignited upon exit from the nozzle by the use of two electrodes 23, as shown in FIG. 2. FIG. 2 shows a pair of electrodes 23 configured in a conventional manner. The tips 24 of the electrodes create a spark across the gap 25 for igniting the atomized oil spray emanating from the nozzle 26.

Figure 3:
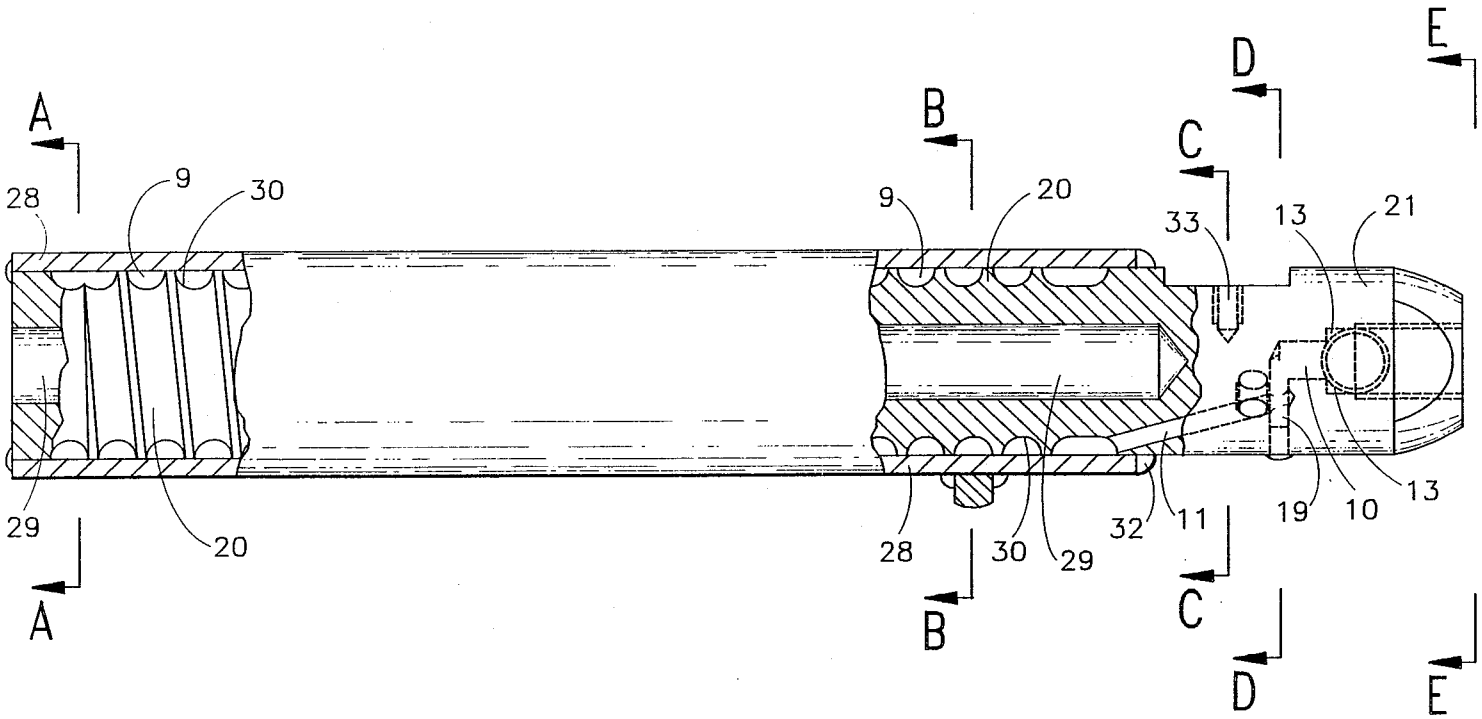
FIG. 3 is a longitudinal cross-section view of the heat transfer assembly.
Figure 4:
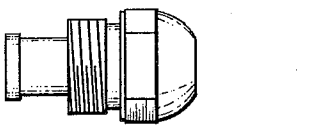
FIG. 4 is a longitudinal view of the conventional type of nozzle that can be used for the atomization of the waste oil.
Figure 5:
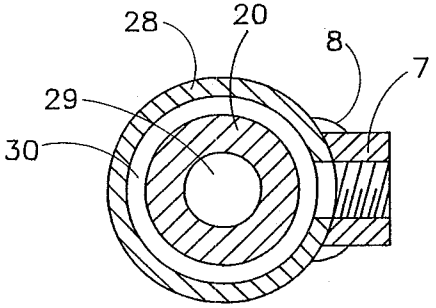
FIG. 5 is a cross-sectional view from Section A—A, in FIG. 3.
Figure 6:
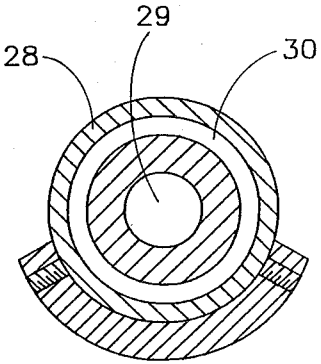
FIG. 6 is a cross-sectional view from Section B—B, in FIG. 3.
Figure 7:
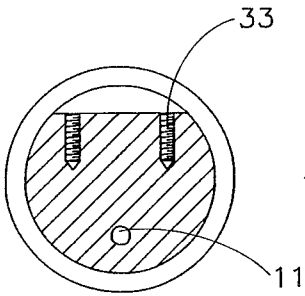
FIG. 7 is a cross-sectional view from Section C—C, in FIG. 3.
Figure 8:
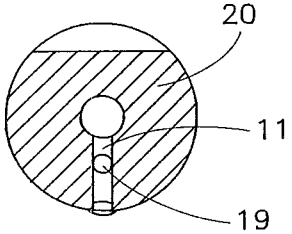
FIG. 8 is a cross-sectional view from Section D—D, in FIG. 3.
Figure 9:
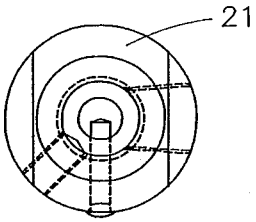
FIG. 9 is a cross-sectional view from Section E—E, in FIG. 3.

FIGS. 2 and 3 show the heat transfer assembly 6 of our invention, which is a machined aluminum assembly. The first part of the assembly is the cylindrical cartridge heating element 27, the second a cylindrical center bored aluminum core component 20, and the third an outer sleeve 28 component which is shrink fit to surround the core component 20. The heat transfer assembly 6 receives heat from the heating element 27, distributes it throughout its configuration and then transfers the heat to the oil in the internal helical passageway 9.

The heating element 27 in the heat transfer assembly 6 is a conventional cartridge type heating element 27, such as one sold by Watlow Electric Manufacturing Company under the Trademark "Firerod". The heating element is located in the central cylindrical cavity 29 bored in the core component 20 of the heat transfer assembly 6, which is drilled to a length of seven and three-quarter inches into the assembly.

The heating element 27 is tightly fit into the central cavity 29 so that heat is easily transferred radially into the core component 20 of the assembly 6. The core component 20 in turn efficiently distributes the heat throughout the assembly, including to the outer sleeve component 28 and the assembly configuration transfers the heat to the oil in the helical passageway 9. The redistribution of the heat received from the heating element 27 and the heat transfer to the oil in the passageway 9 has achieved a sufficiently low watt density to eliminate the coking problems heretofore experienced throughout the industry.

The core component 20 of the heat transfer assembly 6 is machined aluminum cylindrically shaped component, nine and five hundred and sixty-two one thousands inches in length, with an outer diameter of one and one-quarter inches. A seven and thirteen-sixteenths inch long, one-half inch diameter cylindrical shaped cavity 29 is bored out of the center of the core component 20 and along its axis. This cavity 29 houses the electric cartridge heater 27. The heating element 27 is tightly fit into the cavity 29 so that heat is easily transferred to the core component 20 for redistribution throughout the heat transfer assembly 6.

Machined into the outer diameter of the core component 20 are approximately twenty to twenty-one turns of a helically configured groove 30, or three and one-half threads per inch. The machined groove 30 is approximately one-eighth of an inch wide in the axial direction. The groove 30 constitutes the boundary of the oil passageway 9 and is machined one-eighth of an inch deep in the radial direction.

The outer sleeve component 28 of the assembly is a cylindrically shaped and mechanically extruded component 28, with a wall thickness of one-eighth of an inch, an inner diameter of one and one-quarter inches, an outer diameter of one and one-half inches and seven and three-quarter inches in length.

The core component 20 is shrunk fit into the outer sleeve 28 of the heat transfer assembly 6, which portion which contains the oil passageway. To obtain a tight fit and seal, the core component 20 is chilled and the outer sleeve component 28 is heated and the core component 20 is then shrink fit into the outer sleeve 28. The sudden reduction in diameter caused where the core component 20 extends beyond the outer sleeve 28 is welded 32 to further affix and seal the two components of the heat transfer assembly together.

The core component 20 extends beyond the outer sleeve 28 by approximately two inches. This extended portion of the core component 21 contains a passageway 11 and 19 that transfers the oil from the helical passageway 9 to the nozzle filter chamber 13, and houses and receives the male-threaded thermocouple heat sensor 33. This portion of the core component also houses and receives the male-threaded inlet line to the cold startup pressure relief line for the oil pressure system. The extended portion of the core component 21 also contains the extended portion 10 of the nozzle filter chamber 13, a one-eighths of an inch diameter hole drilled along the axis at a length of one and one-eighth inches.

As shown in FIG. 2, the heat transfer assembly 6 also includes two convention threaded screws 34 that screw into the assembly and are use to position the nozzle within the flame cone of the conventional burner housing. The heat transfer assembly 6 is further insulated by means of a one-quarter of an inch thick neoprene insulation layer 31.

The system control means according to this invention uses conventional wiring means and devices which are generally widely known in the field of the invention described and their exact nature or type is not necessary for an understanding and use of the invention by a person skilled in the art and they will not therefore be discussed in detail. The cold startup of the heater unit is accomplished by turning the mode switch to the heavy oil position, which energizes only the heat transfer assembly 6.

The system control means 35 provides the control function on cold startup to energize only the heating element 27, until the heat transfer assembly adjacent to the atomization nozzle attains a temperature of a pre-selected value. Once the pre-selected temperature value is reached, then the system control means 35 energizes the fuel oil pump 4 and energizes the electrodes for igniting the atomized fuel oil exiting the aperture of the atomization nozzle 22. Once the heat transfer assembly 6 reaches set point temperature, and assuming the room thermostat points are closed and communicating the need for heat output, the control system energizes and turns on the main unit motor, the oil fuel pump 4, the electrodes 24 and energizes and therefore closes the normally open expansion oil pressure relief solenoid valve 17.

Once the heat transfer assembly 6 reaches set point temperature, the burner unit goes into its operational cycle, responding to the thermostat. If the thermostat requires no more heat output, the points will open and current will be discontinued to all components except the heat transfer assembly 6, which will remain at set point temperature for quick starting in the operational cycle.

The system control means according to this invention also provides a safety and efficiency shutoff means so that if the temperature measured in the extended portion 21 of the core component 20 of the heat transfer assembly drops ten degrees below the target temperature, the controls will shut the entire system off.

The temperature monitoring and control means 36 includes the location of the receiving means for the thermocouple 33 adjacent to the atomization nozzle 22 and within the extended portion of the core component 21 of the heat transfer assembly 12. The temperature monitoring and control means 36 may also utilize an anticipatory and a rate proportional band function to accomplish the temperature control and monitoring of the fuel oil. This can be accomplished by utilizing a widely-known thermal control system, such as one manufactured and sold by Whatlow Company, St. Louis, Mo.

The temperature monitoring and control means 36 according to this invention uses conventional wiring means and devices which are generally and widely-known in the field of the invention described and their exact nature or type is not necessary for an understanding and use of the invention by a person skilled in the art and they will not therefor be discussed in detail.

The temperature monitoring and control means is operatively connected by conventional wiring means and devices to the temperature monitoring thermocouple received in the extended portion of the core component 21 of the heat transfer assembly 6 and operatively connected to the heating element 27.

The invention claimed is:

1. A waste oil burner feed system apparatus for preheating and then controlling the temperature of fuel oil for the atomization of the fuel oil in cooperation with a waste oil burner, comprising:

a heat transfer assembly which includes a helical oil passageway through an elongated aluminum heat transfer body, which receives heat from a heating element operatively connected to it, and which distributes the heat to fuel oil within its helical oil passageway;

an oil supply line in constant communication with the helical oil passageway in the heat transfer assembly and consequently in constant communication with an atomization nozzle which is securable at a terminal end of the heat transfer assembly;

an oil expansion and pressure relief means which prevents expanding fuel oil from passing through the atomization nozzle on cold startup and prior to the fuel oil attaining a temperature of a pre-selected value, and which prevents fuel oil from passing through the atomization nozzle as a result of residual pressure exerted during the operation cycle after a shutdown, by means of associated configuration of the heat transfer assembly in cooperation with the atomization nozzle and an adjacent pressure relief line in constant communication therewith; and a system control means for cold startup to energize only the heating element, until the heat transfer assembly adjacent to the atomization nozzle attains a temperature of a pre-selected value, at which time said system control means energizes a fuel oil pump means, energizes an air blower, and energizes a means of igniting the atomized fuel oil exiting the aperture of the atomization nozzle.

2. A waste oil burner feed system as recited in claim 1, and further comprising:

a temperature monitoring and control means which measures temperature through the use of a thermocouple operatively connected to the heat transfer assembly adjacent the atomization nozzle and which maintains the temperature adjacent to the atomization nozzle at a pre-selected value, and through the use of an anticipatory proportional band temperature control means operatively associated to the thermocouple and for receipt of temperature readings from the thermocouple and operatively connected to and for the energization of the heating element.

3. A waste oil burner feed system as recited in claim 1, wherein the system control means further comprises:

a means to monitor the temperature in an extended portion of a core component of the heat transfer assembly and to de-energize the fuel oil pump means, de-energize the means of igniting the atomized fuel oil exiting the aperture of the atomization nozzle, and de-energizes the oil pump if the monitored temperature drops below a pre-selected value.

* * * * *